US007794249B2

(12) United States Patent
Yu et al.

(10) Patent No.: US 7,794,249 B2
(45) Date of Patent: Sep. 14, 2010

(54) PUSH-PUSH CARD CONNECTOR

(75) Inventors: Jian-Fei Yu, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,944

(22) Filed: Mar. 30, 2009

(65) Prior Publication Data

US 2009/0246993 A1 Oct. 1, 2009

(30) Foreign Application Priority Data

Mar. 28, 2008 (CN) ..... 2008 2 0033140 U

(51) Int. Cl.
*H01R 13/62* (2006.01)

(52) U.S. Cl. ..... 439/159

(58) Field of Classification Search ..... 439/159, 439/64, 607.01, 607.02, 630, 160
See application file for complete search history.

(56) References Cited

U.S. PATENT DOCUMENTS 6,692,277 B2 * 2/2004 Hu et al. ..... 439/188
6,814,596 B2 * 11/2004 Yu et al. ..... 439/159
6,951,471 B1 10/2005 Chen

* cited by examiner

*Primary Examiner*—Javaid Nasri
(74) *Attorney, Agent, or Firm*—Wei Te Chung; Andrew C. Cheng; Ming Chieh Chang

(57) ABSTRACT

A card connector (100) for connecting an electronic card (200) includes an insulative housing (1), a plurality of contacts (2) retained in the insulative housing (1), and an ejector (3). The insulative housing (1) defines a receiving space (10) for receiving the electronic card (200). The ejector (3) includes a slider (31) retained in the insulative housing (1), a spring (32) and a pole (33) mounted between the slider (31) and a rear end of the insulative housing (1). The slider (31) has an inner side wall (310), an inclined face (3100) angled with respect to the inner side wall (3100) to abut against the electronic card (200), and a protrusion (3102) projecting inwardly from the inner side wall (310) to resist the electronic card (200) sideward. Thereby the electronic card (200) can be inserted in or ejected from the card connector (100) smoothly.

16 Claims, 8 Drawing Sheets

PUSH-PUSH CARD CONNECTOR

BACKGROUND OF THE INVENTION

1. Field of the Invention

The present invention relates to a card connector, more particularly to a push-push card connector with a device which ejects an electronic card from the electronic card connector when the electronic card is withdrawn.

2. Description of Related Art

Small electronic cards with a large memory are used in many kinds of portable electrical products, such as digital cameras, PDAs, mobile phones etc. The electrical product usually has a circuit board with a card connector mounted thereon for electrically connecting the electronic card.

Typically, a card connector includes an insulative housing with a plurality of contacts retained therein, an ejector mounted on the insulative housing and a metal shell covering the insulative housing. The metal shell defines a receiving space for receiving an electronic card. The ejector includes a slider mounted to the insulative housing, a spring and a pole fixed between a rear end of the insulative housing and the slider. The slider can move along a front-to-back direction to bring the electronic card in or out of the card connector. The slider has an inclined face. When the electronic card is inserted into or ejected from the card connector, the electronic card abuts against the inclined face for pushing the slider moving along the front-to-back direction, and strength along a direction perpendicular to the inclined face is produced and drives the electronic card declining which results in that one end of the electronic card rubs the metal shell. Thereby, the electronic card will be frayed, and can not be smoothly inserted into or ejected from the card connector.

Hence, an improved card connector is desired to solve the problem above.

BRIEF SUMMARY OF THE INVENTION

According to one aspect of the present invention, a card connector for connecting an electronic card, comprises: an insulative housing defining a receiving space for receiving the electronic card; a plurality of contacts retained in the insulative housing; and an ejector comprising a slider movably retained in the insulative housing, a spring sandwiched between the slider and a rear end of the insulative housing, and a pole mounted between the slider and the rear end of the insulative housing, the slider has an inner side wall, an inclined face angled with respect to the inner side wall to abut against the electronic card, and a protrusion projecting inwardly from the inner side wall to resist the electronic card sideward. The protrusion positioned at a front side of the inclined face along an insertion direction of the electronic card, thereby the electronic card can be inserted in or ejected from the card connector smoothly.

According to another aspect of the present invention, a card connector comprises: an insulative housing defining a receiving space for receiving an electronic card; a plurality of contacts retained in the insulative housing; an ejector comprising a slider movably retained in the insulative housing, a spring sandwiched between the slider and a rear end of the insulative housing, and a pole mounted between the slider and the rear end of the insulative housing, the slider having an inner side wall and an inclined face to abut against the electronic card, the inner side wall located at a front side of the inclined face along an insertion direction of the electronic card; and an elastic element attached to the inner side wall and having a protrusion extending inwardly into the receiving space to resist a front side of the electronic card sideward, thereby the electronic card can be inserted in or ejected from the card connector smoothly.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
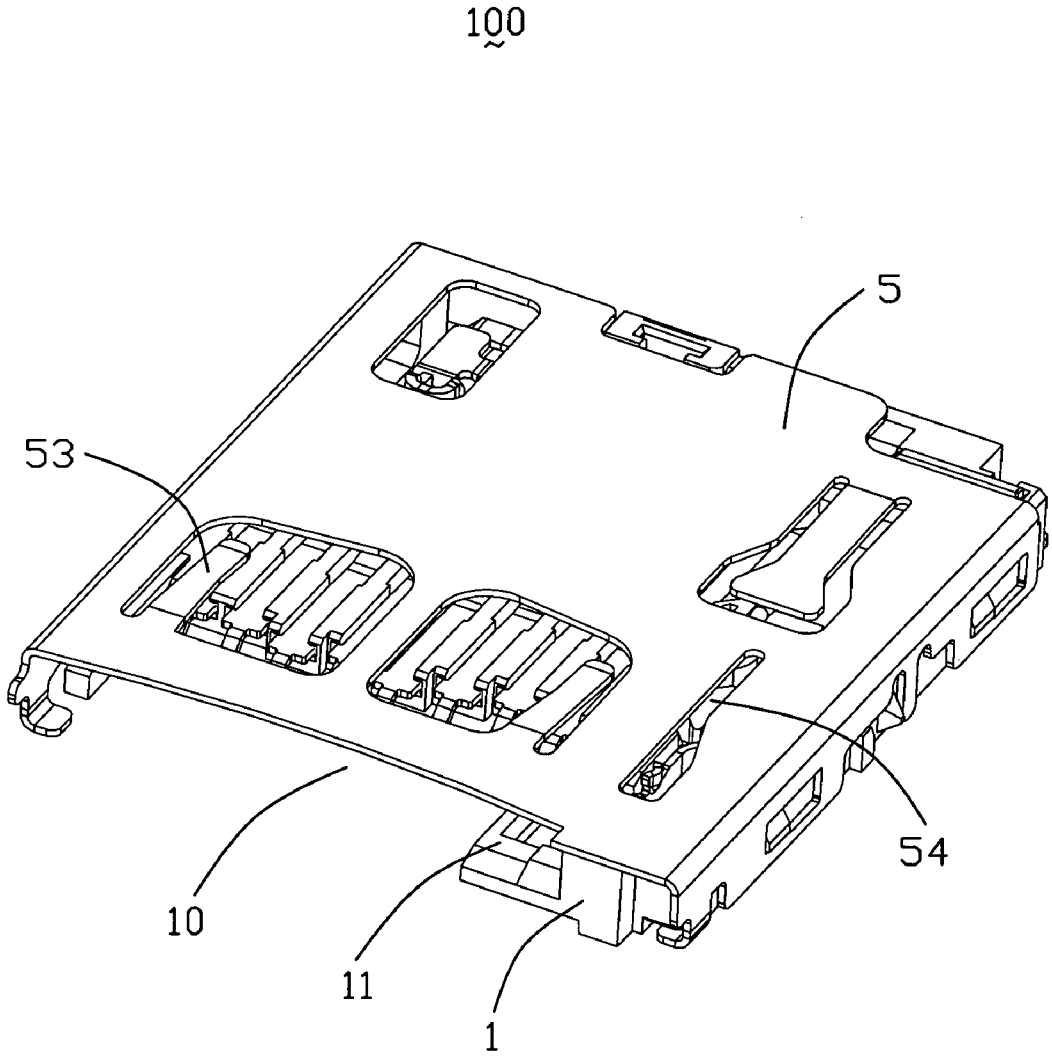
FIG. 1 is a perspective view of a card connector according to one embodiment of the present invention.
Figure 2:
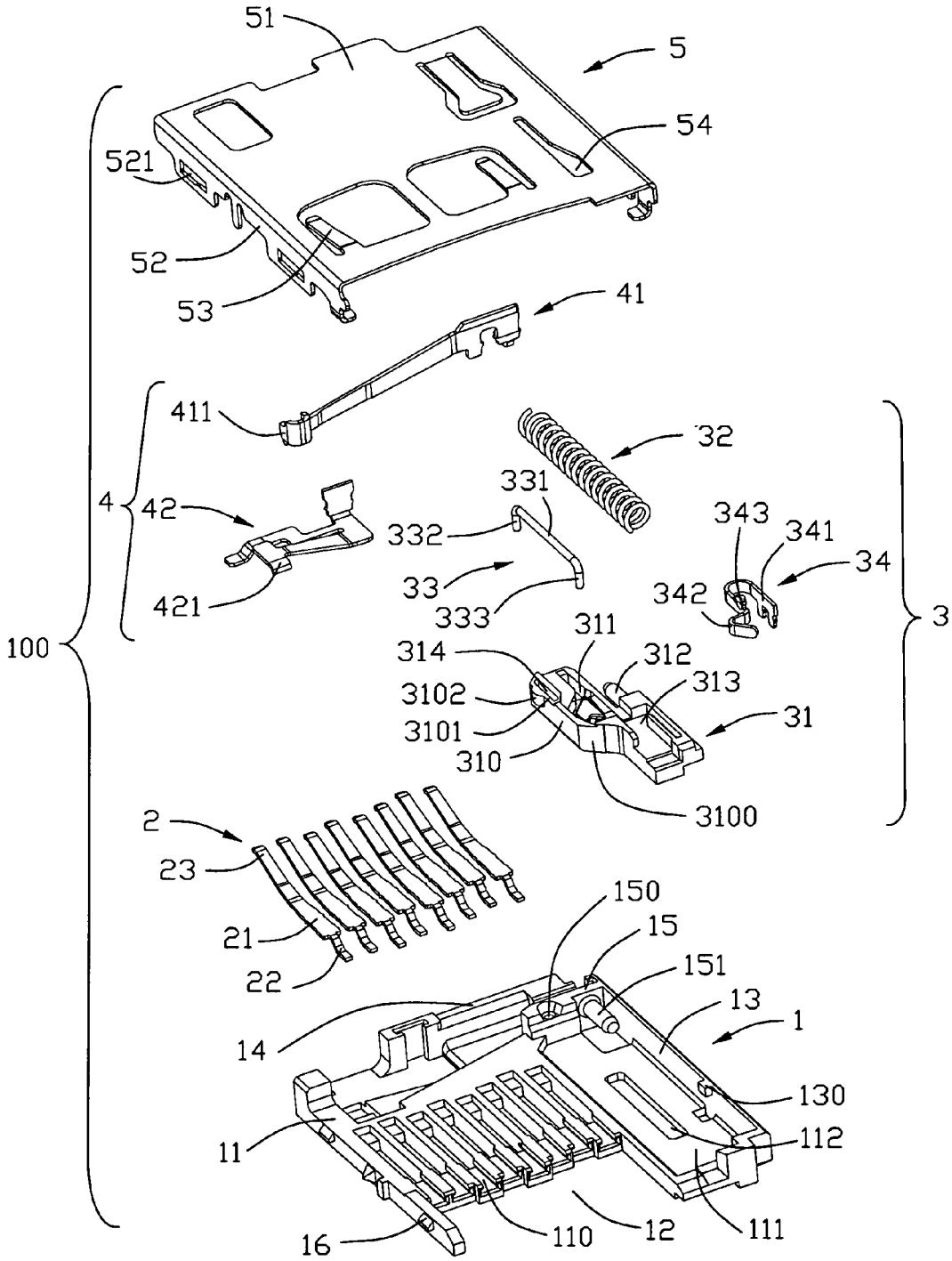
FIG. 2 is an exploded view of the card connector shown in FIG. 1.
Figure 3:
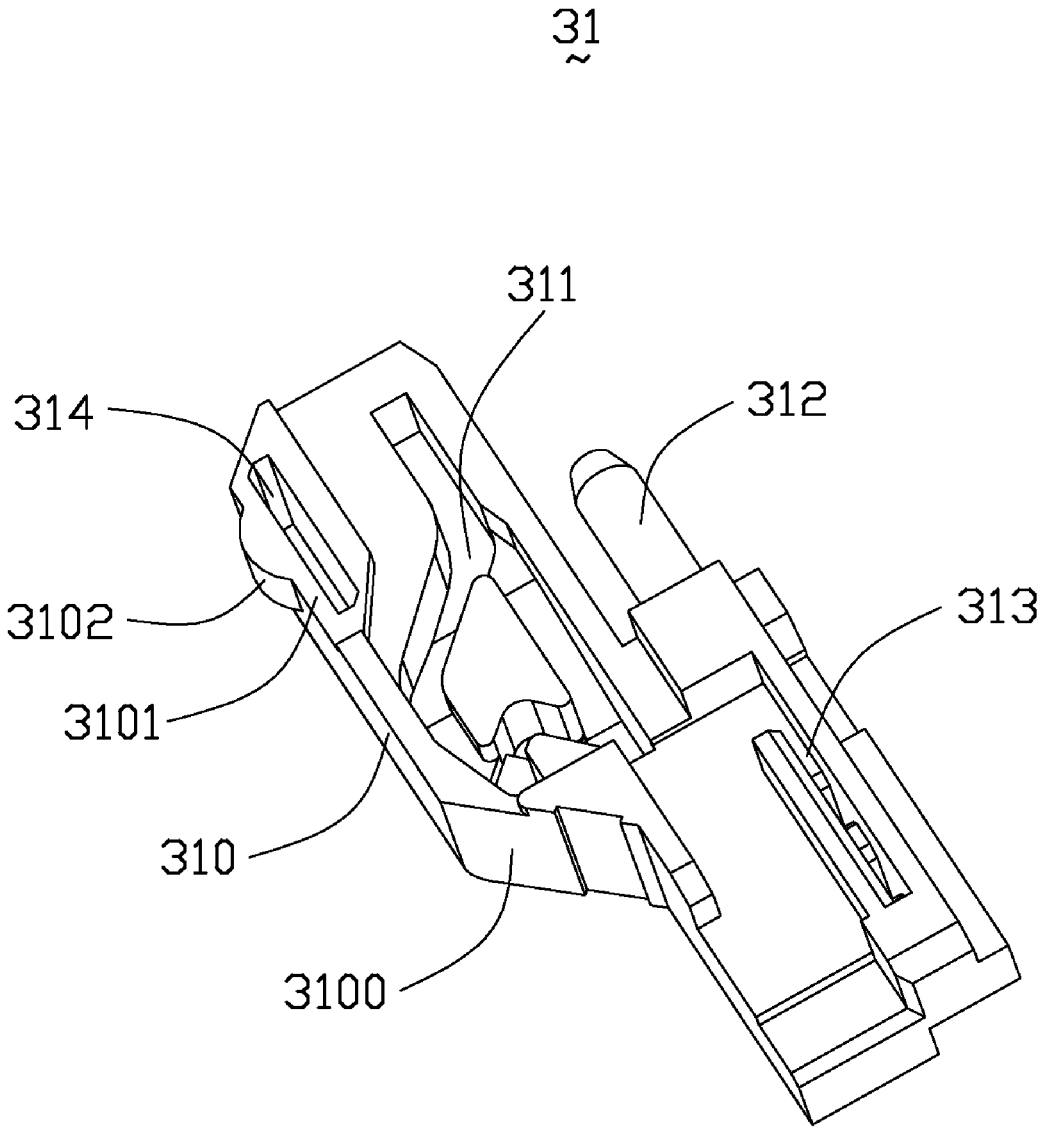
FIG. 3 is a perspective view of a slider of the card connector shown in FIG. 1.
Figure 4:
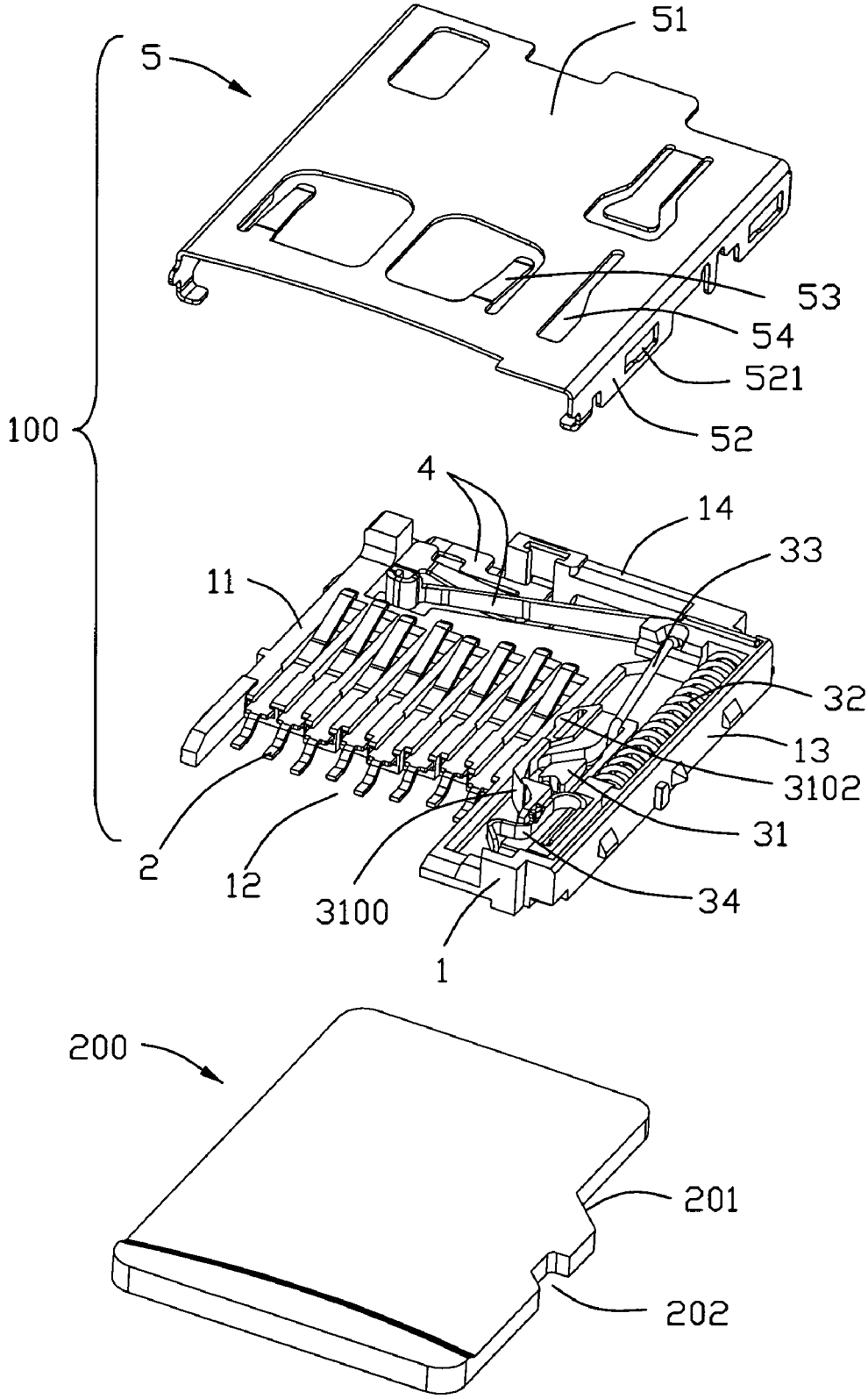
FIG. 4 is a partial exploded view of the card connector with an electronic card not inserted into the card connector.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, a card connector 100 for connecting an electronic card 200 according to one embodiment of the present invention is disclosed. The card connector 100 comprises an insulative housing 1, a plurality of contacts 2 held in the insulative housing 1, an ejector 3 retained in the insulative housing 1, a pair of detecting contacts 4 retained on a rear end of the insulative housing 1 for detecting whether the electronic card 200 is inserted into the card connector 100, and a metal shell 5 covering the insulative housing 1 and forming a receiving space 10 with the insulative housing 1. The electronic card 200 is a Micro SD card in the present invention, and comprises a resisting portion 201 abutting against the ejector 3 and a lock hole 202 at a first side thereof for locking with the card connector 100. The resisting portion 201 is closer with a front end of the electronic card 200 than the lock hole 202.

The insulative housing 1 comprises a bottom wall 11, an inserting port 12 formed at one end of the bottom wall 11, a side wall 13 extending upwardly from one side of the bottom wall 11, and a rear wall 14 opposite to the inserting port 12. The side wall 13 is perpendicular to the bottom wall 11. The receiving space 10 is formed between the bottom wall 11, the side wall 13 and the rear wall 14. The bottom wall 11 defines a plurality of passageways 110 for receiving the contacts 2, and a recessed portion 111 adjacent to the side wall 13 for receiving the ejector 3. The side wall 13 has a block 130 formed on an inside face thereof to prevent the ejector 3 from moving upwardly. The insulative housing 1 has a support wall 15 extending upwardly from a rear end of the recessed portion 111. The support wall 15 is parallel to the rear wall 14, and defines a support hole 150 recessed downwardly from a top side thereof and a first rod 151 extending forwardly. The recessed portion 111 defines a guiding slot 112 penetrating through the bottom wall 11 and extending along a front-to-back direction for guiding the ejector 3 moving in the recessed portion 111. The insulative housing 1 comprises a plurality of projections 16 extending outwardly from two sides thereof for fixing the metal shell 5.

Each contact 2 has a securing portion 21 retained in the passageways 110, a contact portion 23 and a soldering portion 22 extending from two ends of the securing portion 21. The contact portion 23 extends cantileveredly to the receiving space 10 for electrically connecting the electronic card 200.

The ejector 3 comprises a slider 31 movably retained in the recessed portion 111 of the insulative housing 1, a spring 32 sandwiched between the support wall 15 and the slider 31, a pole 33 mounted between the slider 31 and the support wall 15, and an auxiliary terminal 34 attached to the slider 31. The slider 31 has a heart-shaped recess 311 formed on a top side thereof, a second rod 312 located at outside of the heart-shaped recess 311, and an installed groove 313 recessed from the top side thereof and located at a front position of the second rod 312. The heart-shaped recess 311 is arranged at a front side of the slider 21 along an insertion direction of the electronic card 200. The installed groove 313 is located at a rear side of the slider 21 and approximately staggered with the heart-shaped recess 311 along the insertion direction.

The slider 31 has an inner side wall 310 parallel to the side wall 13, and an inclined face 3100 angled with respect to the inner side wall 310 to abut against the resisting portion 201 of the electronic card 200. The inner side wall 310 located at a front side of the inclined face 3100 along the insertion direction of the electronic card 200. The slider 31 defines a through hole 314 penetrating through the top side and a bottom side thereof. The through hole 314 is located at an inner side of the heart-shaped recess 311 to form an elastic element 3101 at a front end of the inner side wall 310. The elastic element 3101 in the embodiment of the present invention is formed integrally with the slider 31, and the elastic element 3101 has a protrusion 3102 projecting inwardly into the receiving space 10 from the inner side wall 310. The protrusion 3102 presents as arc-shaped to guide the electronic card 200 being inserted into the card connector 100 and resist a front side of the electronic card 200 sideward.

One end of the spring 32 rings on the first rod 151 of the insulative housing 1, and another end of the spring 32 rings on the second rod 312 of the slider 31 for securing the spring 32 between the support wall 15 and the slider 31. The spring 32 is compressed when the electronic card 200 is inserted into the card connector 100 and pushes the slider 31 forwardly along the insertion direction, and is released when the electronic card 200 is ejected from the card connector 100. The pole 33 has an elongated base 331 extending along the insertion direction, a first bending portion 332 and a second bending portion 333 extending downwardly from two opposite ends of the base 331. The first bending portion 332 is retained in the support hole 150. The second bending portion 333 is movably received in the heart-shaped recess 311. The auxiliary terminal 34 has an U-shaped support portion 341 retained in the installed groove 313, an elastic lock portion 342 extending into the receiving space 10 from a front end of the support portion 341 for locking with the lock hole 202, and an arc engaging section 343 extending upwardly from a top side of the support portion 341. The lock portion 341 is located at a rear side of the inclined face 3100 along the insertion direction and does not extend beyond the inner side wall 310.

The detecting contacts 4 are retained on the rear wall 14 and located at a rear side of the receiving space 10. The detecting contacts 4 comprise a first detecting contact 41 and a second detecting contact 42. The first detecting contact 41 has a first contact portion 411, and the second detecting contact 42 has a movable second contact portion 421 which can contact or disconnect with the first contact portion 411 along a vertical direction.

The metal shell 5 is made of a piece of metal sheet, and comprises a top wall 51 and a pair of flanges 52 extending downwardly from two opposite sides of the top wall 51. The slider 31 abuts against the first side of the electronic card 200, and one of the flange 52 abuts against a second side of the electronic card 200 opposite to the first side. Each flange 52 defines a plurality of openings 521 for engaging with the projections 16 of the insulative housing 1. The top wall 51 has a pair of spring arm 53 extending into the receiving space 10 at a front side thereof, and a slit 54 arranged at outside of the spring arm 53 for guiding the engaging section 343 moving therein along the front-to-back direction when the electronic card 200 is inserted into or ejected from the card connector 100. The engaging section 343 is arc-shaped for preventing the metal shell 5 from scraping.

Figure 6:
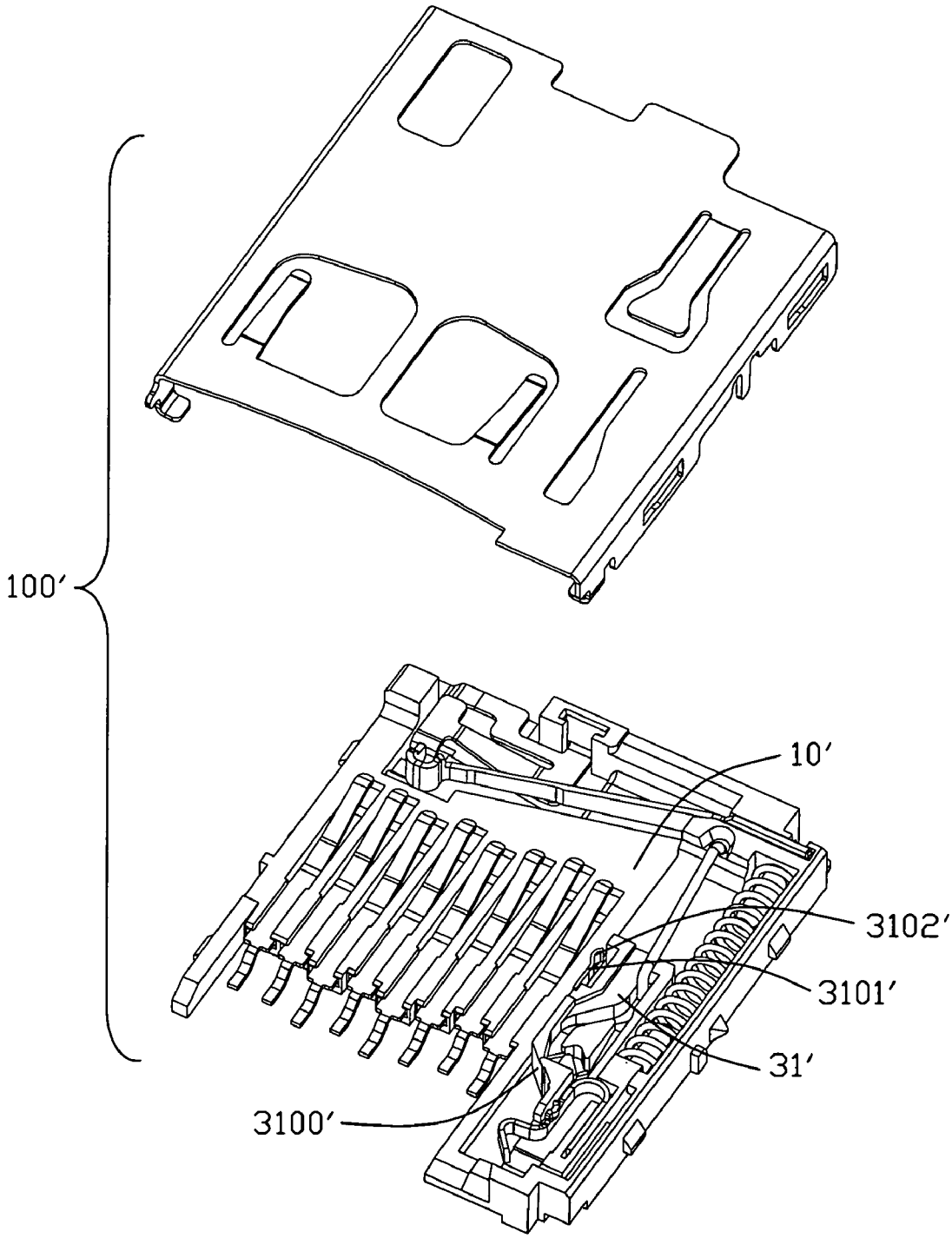
FIG. 6 is a partial exploded view of the card connector according to another embodiment of the present invention.
Figure 7:
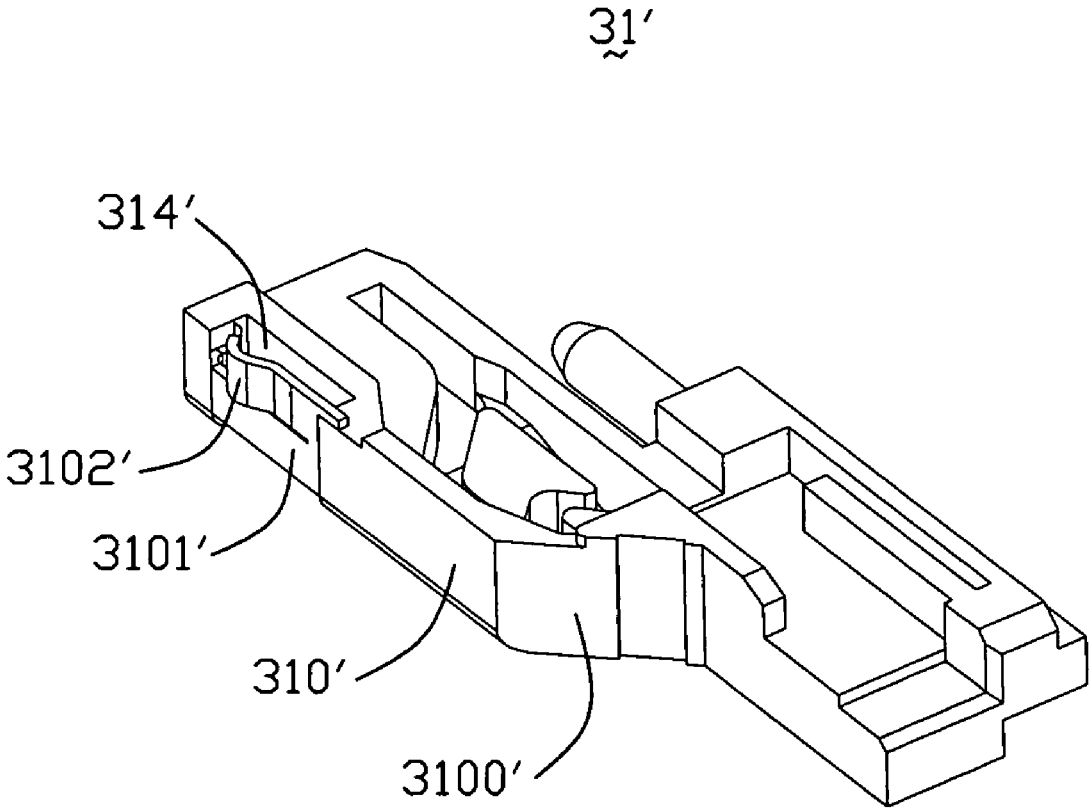
FIG. 7 is a perspective view of a slider of the card connector shown in FIG. 6.
Figure 8:
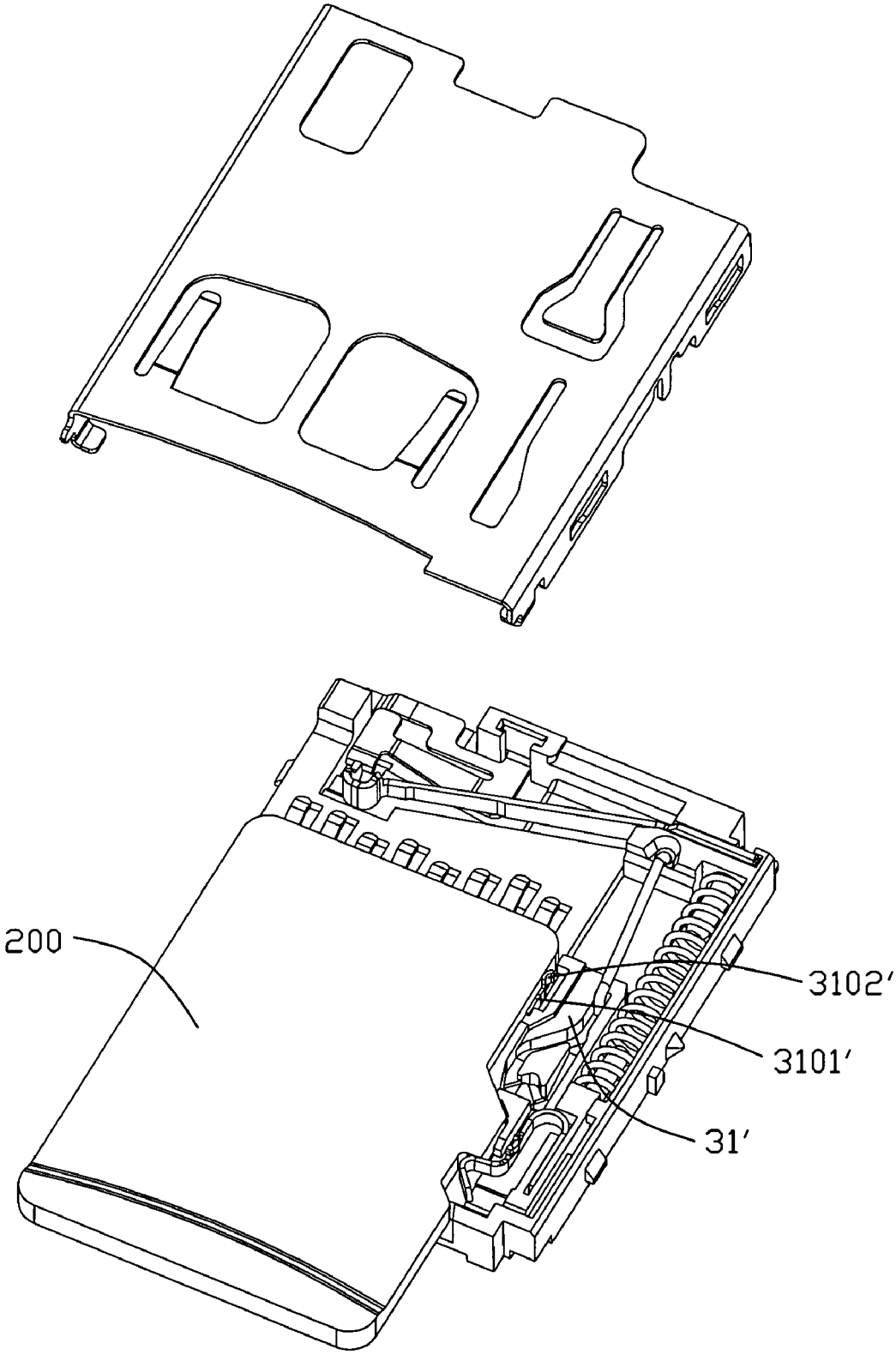
FIG. 8 is a partial exploded view of the card connector shown in FIG. 6 with an electronic card inserted into the card connector.

Referring to FIGS. 6-8, a card connector 100' according to another embodiment of the present invention is disclosed. The card connectors 100, 100' of two embodiment are similar approximately, and a small difference is that: an elastic element 3101' of a slider 31' in the alternative embodiment is a spring tab insert molded to an inner side wall 310' of the slider 31'. Of cause, the spring tab can be installed to an installed slot of an inner side wall of the slider in other embodiments. The spring tab is made of metal material to have a good elasticity. The spring tab has an elastic protrusion 3102' extending sideward therefrom and extending into a receiving space 10' of the card connector 100'. The protrusion 3102' presents as an arc-shaped for guiding the electronic card 200 inserted into the card connector 100' and resisting the electronic card 200 sideward. The slider 31' defines a cutout 314' recessed outwardly from the inner side wall 310' to form a space wherein the spring tab can deflect. The slider 31' has an inclined face 3100' to abut against the electronic card 200.

In process of inserting the electronic card 200 into the receiving space 10, 10', the lock portion 42 locks with the lock hole 202 of the electronic card 200 firstly; and the protrusion 3102, 3102' of the slider 31, 31' resists the front side of the electronic card 200 sideward; and the resisting portion 201 of the electronic card 200 abuts against the inclined face 3100, 3100'; and the spring arms 53 press a top side of the electronic card 200 at the same time for assuring the electronic card 200 moving smoothly. When further pushing the electronic card 200 forwardly, the resisting portion 201 resists the inclined face 3100, 3100' for driving the slider 31, 31' moving forwardly, and the second bending portion 333 of the pole 33 moves backwardly in the heart-shaped recess 311 at the same time. When the electronic card 200 is inserted into the receiving space 10, 10' completely, the second bending portion 333 moves to a front end of the heart-shaped recess 311, and the first contact portion 511 and the second contact portion 521 contact with each other along the vertical portion for completing detecting function; the spring 32 is compressed to a small length at the same time.

When pushing the electronic card 200 again, the second bending portion 333 moves forwardly from a front end of the heart-shaped recess 311, and the spring 32 is released and pushes the slider 31 moving backwardly, then the electronic card 200 is ejected from the card connector 100 via the inclined face 3100, 3100' abutting against the resisting portion 201.

Figure 5:
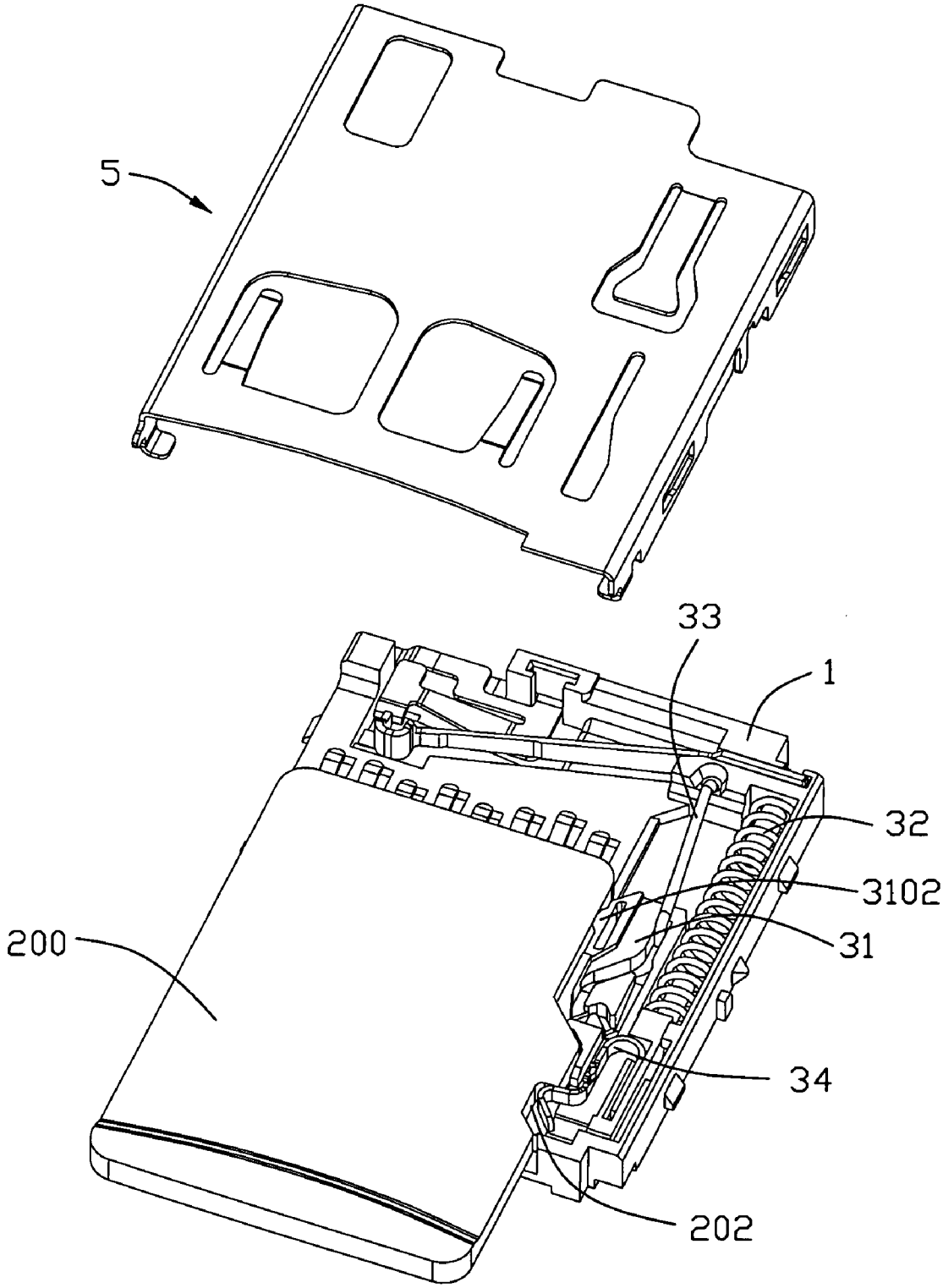
FIG. 5 is a partial exploded view of the card connector with an electronic card inserted into the card connector.

Referring to FIGS. 5 and 8, in the present invention, when the electronic card 200 is inserted into or ejected from the card connector 100, the inclined face 3100, 3100' resists the resisting portion 201 of the electronic card 200 which results in the rear end of the electronic card 200 declines along a direction perpendicular to the inclined face 3100, 3100', and at the same time the elastic protrusion 3102, 3102' resists the front side of the electronic card 200 sideward for assuring the front side and the rear side aligned with each other along the front-to-back direction; Thereby, the electronic card 200 can be inserted smoothly into the receiving space 10, 10' or ejected smoothly from the receiving space 10, 10', and the electronic card 200 can not be frayed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A card connector for connecting an electronic card, comprising:

an insulative housing defining a receiving space for receiving the electronic card, the insulative housing having a bottom wall, an inserting port at one end of the bottom wall and a rear wall opposite to the inserting port along an insertion direction of the electronic card;

a plurality of contacts retained in the insulative housing; and an ejector comprising a slider movably retained in the insulative housing, a spring sandwiched between the slider and a rear end of the insulative housing, and a pole mounted between the slider and the rear end of the insulative housing, the slider having an inner side wall, an inclined face angled with respect to the inner side wall to abut against the electronic card, and a protrusion integrally projecting inwardly from the inner side wall in a resilient manner to resiliently resist the electronic card sideward, the inner side wall being closer to the rear wall than the inclined face along the insertion direction;

wherein the slider defines a through hole at an outside of the protrusion to form an elastic element on the inner side wall thereof, the protrusion integrally extends from the elastic element and can elastically moves outwardly when the electrical card is inserted into the receiving space and presses the protrusion.

2. The card connector as claimed in claim 1, wherein the electronic card has a front end with a plurality of metal fingers to mate with the contacts, a resisted area at a front side edge thereof and a lock hole at a rear side edge thereof, the resisted area is closer to the front end than the lock hole, and the protrusion presents as an arc-shaped to resist the resisted area sideward.

3. The card connector as claimed in claim 2, wherein the slider defines an installed groove recessed from a top face thereof, the ejector further comprises an auxiliary terminal with a support portion retained in the installed groove and a lock portion extending inwardly into the receiving space for locking with the lock hole.

4. The card connector as claimed in claim 1, wherein the through hole penetrates through a top side and a bottom side of the slider, and the elastic element is arranged at a front end of the inner side wall near to the rear wall and connects with the inner side wall at front and rear ends thereof along the insertion direction.

5. The card connector as claimed in claim 3, wherein the lock portion is located at a rear side of the inclined face along the insertion direction and does not extend beyond the inner side wall.

6. The card connector as claimed in claim 3, further comprising a metal shell covering the insulative housing, wherein the metal shell defines a slit, and the auxiliary terminal has an arc engaging section extending upwardly from the support portion, the engaging section can move along a front-to-back direction in the slit.

7. The card connector as claimed in claim 1, wherein further comprising a metal shell, the metal shell comprises a top wall and a pair of flanges extending downwardly from opposite two sides of the top wall, wherein the slider abuts against a first side of the electronic card, and one of the flange abuts against a second side of the electronic card opposite to the first side.

8. The card connector as claimed in claim 1, wherein the slider defines a heart-shaped recess formed on a top side thereof, one end of the pole is positioned on the insulative housing, and another end of the pole is received movably in the heart-shaped recess.

9. The card connector as claimed in claim 1, wherein the insulative housing has a side wall perpendicular to the bottom wall, and the side wall comprising a block formed on an inside face thereof to prevent the ejector from moving upwardly.

10. The card connector as claimed in claim 1, further comprising a pair of detecting contacts positioned at a rear side of the insulative housing, and each detecting contact has a contact portion which can contact with each other along a vertical direction.

11. A card connector comprising:

an insulative housing defining a receiving space for receiving an electronic card, the insulative housing having a bottom wall, an inserting port at one end of the bottom wall and a rear wall opposite to the inserting port along an insertion direction of the electronic card;

a plurality of contacts retained in the insulative housing;

an ejector comprising a slider movably retained in the insulative housing, a spring sandwiched between the slider and a rear end of the insulative housing, and a pole mounted between the slider and the rear end of the insulative housing, the slider having an inclined face to abut against the electronic card, and a front inner side wall and a rear inner side wall oppositely extending from two ends of inclined face along the insertion direction, the front inner side wall being closer to the rear wall than the rear inner side wall and located at an inner side of the rear inner side wall along a transverse direction perpendicular to the insertion direction; and an elastic element attached to the front inner side wall and having a protrusion extending inwardly into the receiving space, the protrusion resiliently resists a front side of the electronic card sideward in the transverse direction to balance a sideward force from the inclined face to a rear side of the electronic card in an insertion/ejecting process of the electronic card.

12. The card connector as claimed in claim 11, wherein further comprising a metal shell, the metal shell comprises a top wall and a pair of flanges extending downwardly from opposite two sides of the top wall, wherein the slider abuts against a first side of the electronic card, and one of the flange abuts against a second side of the electronic card opposite to the first side.

13. The card connector as claimed in claim 11, wherein the elastic element is either a metal spring tab.

14. The card connector as claimed in claim 13, wherein the slider defines a cutout recessed outwardly from the front inner side wall to form a space wherein the spring tab can deflect.

15. The card connector as claimed in claim 11, wherein the slider defines an installed groove recessed from a top face thereof and located at an outer side of the rear inner side wall, the ejector further comprises an auxiliary terminal with a support portion retained in the installed groove and a lock portion extending inwardly into the receiving space.

16. The card connector as claimed in claim 15, wherein the lock portion is located at a rear side of the inclined face along the insertion direction and does not extend beyond the front inner side wall along the transverse direction.

* * * * *